US005249317A

United States Patent [19]

Farlow

[11] Patent Number: 5,249,317

[45] Date of Patent: Oct. 5, 1993

[54] INVERTED-L MECHANISM FOR FACILITATING THE FOLDING OF A CONVERTIBLE SOFA-BED

[76] Inventor: Mark E. Farlow, 5318 E. 7th St., Tucson, Ariz. 85711

[21] Appl. No.: 13,428

[22] Filed: Feb. 4, 1993

[51] Int. Cl.[5] ..... A47C 17/17

[52] U.S. Cl. ..... 5/37.1; 5/41; 5/42.1

[58] Field of Search ..... 5/37.1, 41, 42.1, 47, 5/48

[56] References Cited

U.S. PATENT DOCUMENTS

| | | | |
|---|---|---|---|
| 2,730,727 | 1/1956 | Schneller | 5/47 X |
| 3,867,730 | 2/1975 | Wright | 5/42.1 |
| 4,538,308 | 9/1985 | Grigoriev | 5/42.1 |
| 4,939,802 | 7/1990 | Lufer | 5/42.1 |

*Primary Examiner*—Michael F. Trettel

*Attorney, Agent, or Firm*—Antonio R. Durando; Harry M. Weiss

[57] ABSTRACT

A convertible sofa-bed that includes a deck comprising three flat panels hinged to one another and foldably mounted on a horizontal support frame that permits their disposition either in a bed or a sofa configuration. As a sofa, the first, front panel constitutes the seat; the second, middle panel constitutes the front portion of the back; and the third, rear panel constitutes the rear portion of the back. As a bed, all three panels lay on the same horizontal plane. Conversion from the bed to the sofa configuration is achieved by folding the panels about their common hinges, which is initiated by an inverted-L mechanism pivotally mounted under the panels so as to cause the initial break of the plane between the middle an rear panels when the front panel is lifted. Once this initial break occurs, the folding of the panels is easily accomplished by pushing the front panel backwards.

6 Claims, 2 Drawing Sheets

INVERTED-L MECHANISM FOR FACILITATING THE FOLDING OF A CONVERTIBLE SOFA-BED

BACKGROUND OF THE INVENTION

1. Field of the Invention

This invention is related in general to the field of convertible sofas and chairs and, in particular, to a mechanism that facilitates the unfolding of a sofa or a chair into a flat bed and the re-folding thereof.

2. Description of the Prior Art

Sofas and chairs that convert into beds have long been popular in homes throughout the world. The convertible unit that provides a place to sit by day and a place to sleep by night is often a necessity in small apartments, especially the one-room dwellings commonly referred to as efficiency apartments. Even larger homes often utilize convertible sofas as "pop-out" guest bedrooms.

Over the years inventors have developed a wide variety of these sofas and chairs that convert to beds and many different mechanisms for accomplishing the conversion. In U.S. Pat. No. 482,262 (1892), for example, Miller describes what was probably the first modern sofa bed. The seat and back portions of the sofa are hinged to the frame to permit the former to slide forward and the latter to pivot to a horizontal position next to the seat. Thus, the two portions may be moved to the desired position to obtain either a sofa or a bed.

U.S. Pat. No. 1,062,337 to Kampe (1913) discloses a collapsible frame for a divanette, whereby the seat and back portions can be folded open to provide a flat bed area. A system of levers attached to the frame enables a user to easily close and open the divanette.

U.S. Pat. No. 2,291,677 to Bank (1942) shows another bed-couch combination having two substantially equal portions constituting the seat and back of a couch. When needed as a bed, the back can be reclined to a horizontal position to form a flat bed surface. A system of springs linking the portions to the supporting frame facilitates the lifting of the various parts to change from one form to the other.

Another sofa bed is described in U.S. Pat. No. 3,002,198 to Kaiser (1961). Three side-by-side panels, hinged to one another along their length, may be positioned on a horizontal frame to form a bed, or folded to make a sofa. Two of the panels fold back to back to create the vertical portion of the sofa, while the third panel slides horizontally to form the seat. Again, various springs aid the process of folding and unfolding the sofa.

U.S. Pat. No. 3,107,363 to Simmons (1963) discloses a hinge mechanism designed to permit the back portion of a sofa bed to be perfectly aligned with the seat portion when the two are in horizontal position. The patent is directed at the specific structure constituting the hinge mechanism, providing a pivot point approximately at the same height as the frame of the sofa bed. This enables the construction of a sofa bed that does not expose the pivot points in its open position.

U.S. Pat. No. 4,205,405 to Hagney (1980) describes another convertible couch comprising a back portion hinged to a seat portion that slide forward to form a bed. Arm-rest pieces are used to fill the gap that exists between the seat and the back when they are positioned horizontally.

Finally, U.S. Pat. No. 4,543,675 to Shrock (1985) teaches the construction of a convertible seat for a vehicle. A system of scissor levers anchored to the frame of the seat permit its conversion to a full-size bed by mechanically rearranging three panels from a seat-back configuration to a horizontal plane.

Many available sofa-beds convert by means of complex mechanisms that often require much strength and are difficult to manipulate and that, because of the arrangement of the numerous parts, at times produce an uncomfortable sleeping surface. Many are further complicated by having a separate mattress actually folded into the unit or by requiring the removal of cushions and pillows before the unit can be folded out. The result is that the process of converting a sofa-bed from one configuration to the other is usually cumbersome and difficult to accomplish by one person alone, especially the operation of folding the open bed into a sofa. Therefore,, there exists a need for a mechanism that facilitates this operation, so that it can be easily accomplished with minimum effort by a person alone.

BRIEF SUMMARY OF THE INVENTION

One objective of this invention is a mechanism to facilitate the conversion of a sofa-bed from its bed to its sofa configuration.

Another objective of this invention is a mechanism that can be used with conventional sofa-bed construction.

A further objective of the invention is a sofa-bed that can be converted quickly, easily and without much strength even by a person alone.

Another goal is a mechanism that is particularly suitable for a convertible sofa-bed without a separate mattress folded into the unit.

A further goal is a comfortable sofa or chair that does not need additional cushions or pillows that must be removed prior to conversion into a bed.

A final objective is the easy and economical manufacture of the invention according to the above stated criteria. This is achieved by using commercially available components and materials, modified only to the extent necessary to fit the requirements of the invention.

Therefore, according to these and other objectives, the present invention consists of a convertible sofa-bed including a deck comprising three flat panels hinged to one another and foldably mounted on a horizontal support frame that permits their disposition either in a bed or a sofa configuration. As a sofa, the first, front panel constitutes the seat; the second, middle panel constitutes the front portion of the back; and the third, rear panel constitutes the rear portion of the back. As a bed, all three panels lay on the same horizontal plane. Conversion from the bed to the sofa configuration is achieved by folding the panels about their common hinges, which is initiated by an inverted-L mechanism pivotally mounted under the panels so as to cause the initial break of the plane between the middle an rear panels when the front panel is lifted. Once this initial break occurs, the folding of the panels is easily accomplished by pushing the front panel backwards.

Various other purposes and advantages of the invention will become clear from its description in the specifications that follow and from the novel features particularly pointed out in the appended claims. Therefore, to the accomplishment of the objectives described above, this invention consists of the features hereinafter illustrated in the drawings, fully described in the detailed description of the preferred embodiment and particularly pointed out in the claims. However, such drawings and description disclose but one of the various ways in which the invention may be practiced.

DETAILED DESCRIPTION OF THE PREFERRED EMBODIMENT

The heart of this invention lies in the inverted-L mechanism utilized to facilitate the folding of a sofa-bed from a bed to a sofa configuration. In all cases, such conversion involves breaking the plane of the deck supporting the mattress of the bed into separate panels, two of which then become the seat and the back of the sofa, respectively. This is achieved by applying forces to the deck that cause it to buckle and bend along predetermined break lines between adjacent panels. Because the force required to cause the initial break of the deck is relatively great, especially where the break is in the upward direction, springs and levers are normally used to facilitate the operation. For a certain type of sofa-bed construction, this invention provides an effective and simple mechanism for facilitating such initial break.

Figure 1:
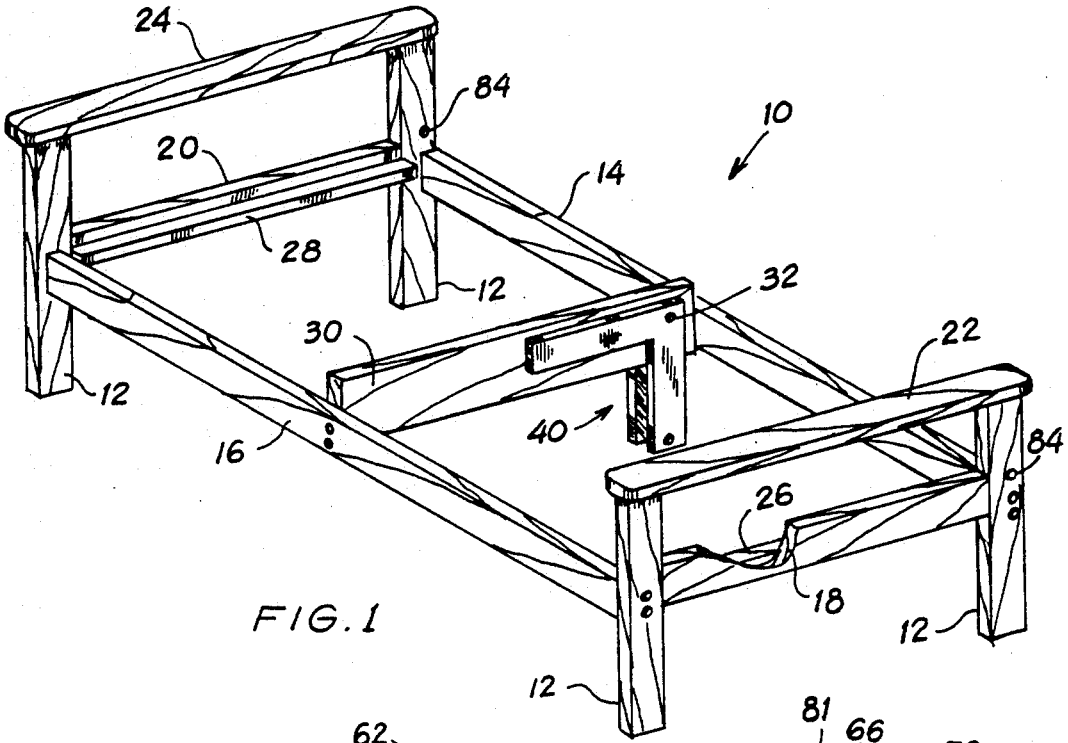
FIG. 1 is a partially cut-away perspective view of a sofa-bed support frame comprising the inverted-L mechanism of the invention.

Referring to the drawings, wherein like parts are designated throughout with like numerals and symbols, FIG. 1 illustrates in perspective view (partially cut away) a typical horizontal support frame 10 for a convertible sofa bed, including the inverted-L mechanism 40 that constitutes the essence of this invention. Generally, the support frame 10 comprises four legs 12 rigidly connected by a rear brace 14, a front brace 16, a right brace 18 and a left brace 20. Right and left armrests 22 and 24, respectively, are also rigidly connected to the front and rear legs and provide further structural strength to the frame. Side rails 26 and 28 are attached to the inner portion of the right and left braces, respectively, to provide support for a deck (not seen in FIG. 1) that constitutes the supporting surface of the sofa-bed. Different support frames are known in the art, equivalent in structure and function, and any of them could obviously be used to implement this invention.

Figure 3:
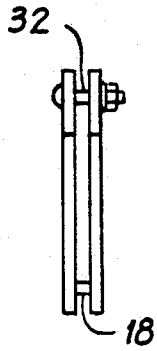
FIG. 3 is a side view of the inverted-L mechanism illustrated in FIG. 2.
Figure 2:
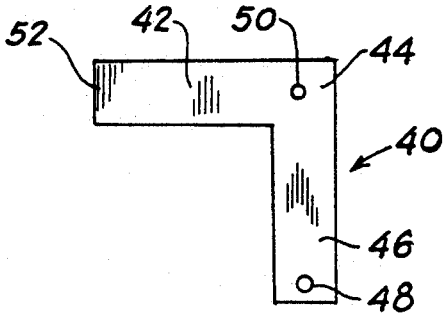
FIG. 2 is a front elevational view of the preferred embodiment of the inverted-L mechanism of the invention.

For the purposes of this invention, an additional support brace 30 is rigidly mounted between the rear and front braces 14 and 16, to provide a bracket with a hinge opening therewithin (not seen in the figures) for pivotally coupling the inverted-L mechanism 40 to the support frame 10. An equivalent bracket could obviously be attached to the rear brace 14, or formed in place of the support brace 30. As illustrated in FIG. 2, the mechanism 40 consists of an L-shaped structure having a first, horizontal arm 42 connected through a right-angle elbow 44 to a second, vertical arm 46. Although not essential to the functioning of the invention, the mechanism 40 may comprise two equal L-shaped structures disposed in overlapping relationship and joined by a dowel 48 or equivalent fastening means connecting the two portions forming the vertical arm 46, as seen in the side elevational view of FIG. 3. Thus, the mechanism 40 can be coupled to the rear portion of the support brace 30 in the frame 10 by means of a horizontal hinge-pin 32 inserted through the hinge openings 50 in the elbow 44. The mechanism 40 is disposed with the first, horizontal arm 42 facing the front of the sofa-bed and the second, vertical arm 46 facing downward, so that the forward rotation of the second arm 46 about the axis of the hinge-pin 32 causes the tip 52 of the first, normally-horizontal arm 42 to point upward.

Figure 4:
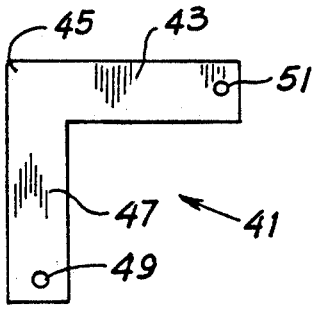
FIG. 4 is a front elevational view of another embodiment of the inverted-L mechanism of the invention.

In an equivalent embodiment of the invention shown in FIG. 4, the inverted-L mechanism 41 is positioned backwards on the support brace 30 (that is, with the first, horizontal arm 43 facing the rear of the sofa-bed and the second, vertical arm 47 facing downward). Again, although not essential to the functioning of the invention, the mechanism 41 may comprise two equal L-shaped structures disposed in overlapping relationship and joined by a dowel 49 or equivalent fastening means connecting the two portions forming the vertical arm 47. Thus, the mechanism 40 can be coupled to the rear portion of the support brace 30 in the frame 10 by means of a horizontal hinge-pin 32 inserted through the hinge openings 51 in the horizontal arm 47. Obviously, the mechanism 41 is disposed with the horizontal arm 43 facing the rear of the sofa-bed, so that the forward rotation of the second arm 47 about the axis of the hinge-pin 32 causes the elbow 45 to point upward. As would be obvious to those skilled in the art, equivalent embodiments of these inverted-L mechanisms can be obtained by any geometrical configuration that contains two structures disposed at an angle and pivotally connected to the frame 10 as shown for the embodiments of either FIG. 2 or FIG. 4.

Figure 5:
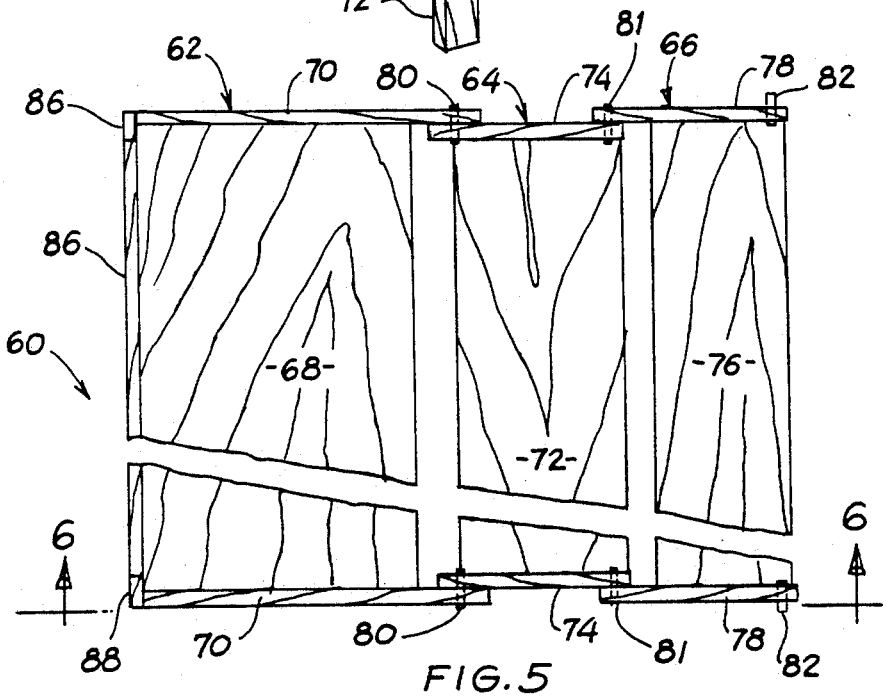
FIG. 5 is a plan view of a three-panel deck used in conjunction with the frame of FIG. 1 to produce the structure of a convertible sofa bed.

The present invention also comprises a three-panel deck used in conjunction with the frame and mechanisms illustrated in FIGS. 1-4. As seen in the plan and side views of FIGS. 5 and 6, such a deck 60 comprises a front panel 62, a middle panel 64 and a rear panel 66 which are hinged to one another. In particular, the front panel 62 comprises a flat board 68 connected to two supporting side members 70; the middle panel 64 comprises a flat board 72 connected to two supporting side members 74; and the rear panel 66 comprises a flat board 76 connected to two supporting side members 78. Each panel could equivalently consist of a truss of parallel slats, rather than a single flat board.

Figure 6:
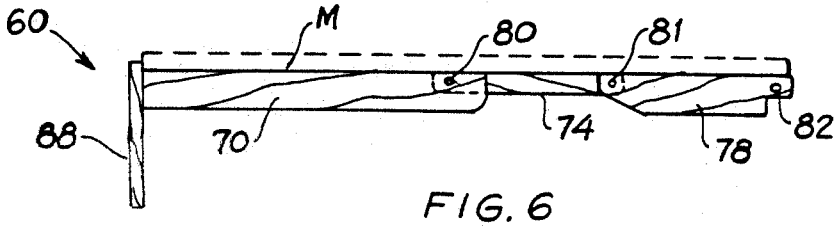
FIG. 6 is a side view of the three-panel deck as seen from line 6—6 in FIG. 5.

The supporting side members of the middle panel 64 are hingedly connected to the supporting side members of the front panel 62 by means of pins 80 and to the supporting side members of the rear panel 66 by means of pins 81. In turn, the supporting side members of the rear panel are hinged to the frame 10 by means of pins 82 passed through receiving openings 84 in the two rear legs 12. Finally, the deck 60 comprises a base board 86, which may be slightly raised with respect to the three panels (as shown in FIG. 6) in order to prevent a mattress M (illustrated in broken line in the figure) from sliding forward, and two legs 88 for resting the front panel of the deck on a supporting surface. Thus, it is readily apparent that by mounting the deck 60 over the support frame 10 and connecting them through the pins 82, a structure is obtained that can be configured either as a bed or a sofa, depending on whether the deck is laid open or is folded along the break lines between the sets of hinge pins 80 and 81. FIG. 6 is a side view of the three-panel deck as seen from line 6—6 in FIG. 5.

Figure 7:
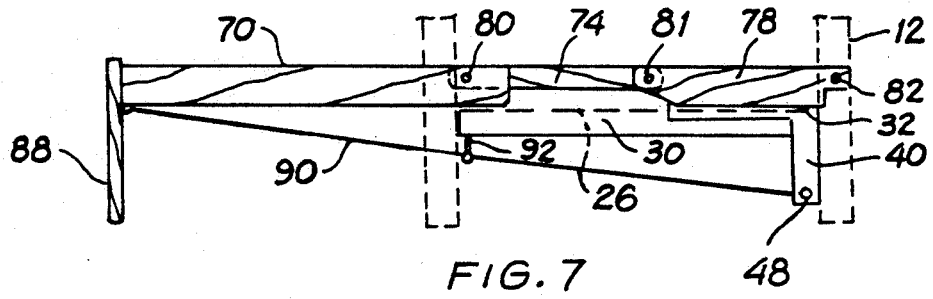
FIGS. 7, 8 and 9 illustrate the operation of the inverted-L mechanism of the invention in converting a sofa-bed from a bed to a sofa configuration.
Figure 8:
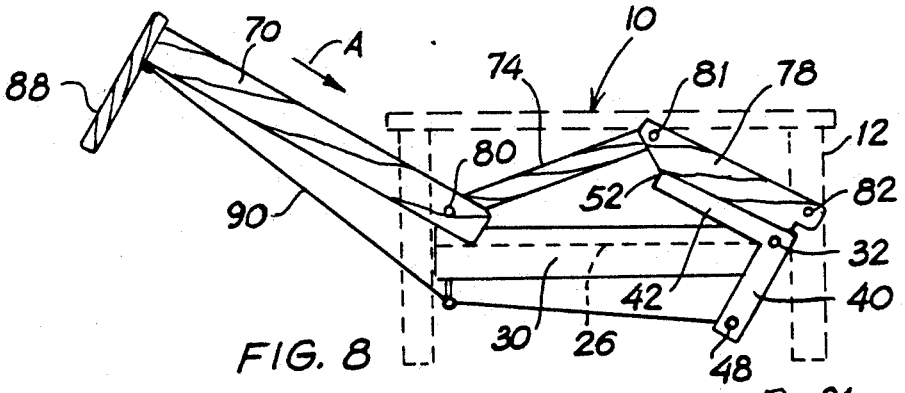
Figure 9:
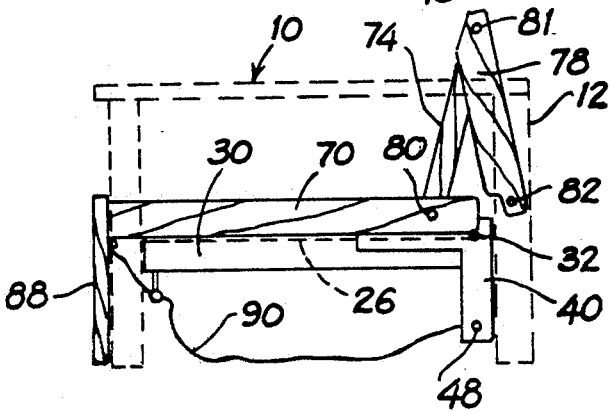

The functioning and operation of the invention is illustrated in FIGS. 7–9, wherein the support frame 10 is shown only in schematic broken line for simplicity. The location of the openings 84 in the two rear legs 12 of the frame 10 and the length of the front and rear side members 70 and 78 of the deck 60 are chosen so as to cause the front and rear side members to rest on the rails 26 and 28 on both sides of the frame 10 when the deck is open. Moreover, the length of the legs 88 is chosen to correspond to the height of the frame, so that the front panel 62 of the deck is horizontal and coplanar with the middle and rear panels when the deck is open. As seen in FIG. 7, the inverted-L mechanism 40, pivotally anchored to the support brace 30, is sized so that its horizontal arm 42 conforms to the length of the rear panel 66 and the tip 52 of the arm lies approximately under the hinge line between the middle and rear panels 64 and 66, respectively.

A strap or cord 90 is attached to the dowel 48 in the inverted-L mechanism and to the underside of the front panel 62 (preferably to the base board 86), so that it is tightly drawn between the two points of attachment when the deck 60 is open to a bed configuration. A rigid guide 92, having the cord 90 threaded therethrough, may be added to the underside of the sofa-bed to ensure that the cord remains taut and that it does not get tangled with moving parts as the deck is folded to form a sofa.

In operation, as the front panel 62 is lifted by a user, braking the deck plane along the break line between the two pins 80, the cord 90 pulls the vertical arm 46 of the inverted-L mechanism 40 forward, causing it to rotate around the hinge-pin 32. This motion in turn causes the tip 52 of the horizontal arm 42 to push against the flat board 76 of the rear panel 66 of the deck and lift it up. Thus, the plane between the middle and rear panels 64 and 66 is also broken along the break line between the two pins 81, initiating the folding of the deck into a sofa configuration (see FIG. 8).

Once the upward folding of the middle and rear panels has begun, the process of completely folding them may be easily accomplished simply by pushing the front panel 62 downward and backwards, as indicated by the arrow A in FIG. 8, thus causing the side members 70 to slide over the side rails 26 and 28 attached to the inner portion of the right and left braces. After the front panel is completely pushed backwards, it may be positioned to again rest horizontally on the frame 10 with the two legs 88 on the supporting surface, thus providing a seat for the sofa configuration of the sofa-bed. As seen in FIG. 9, the middle panel and rear panels become the back of the sofa. The sofa-bed can then be reconverted to a bed by pulling the front panel 62 forward and repositioning all three panels in a horizontal configuration. Thus, the inverted-L device herein described provides a simple mechanism for improving the operation of folding the sofa-bed by facilitating the initial buckling of the bed deck, which normally constitutes the hardest step in the process. The device is inexpensive and well suited for use in conjunction with any multiple-panel sofa-bed geometries.

Although FIGS. 7–9 do not show it for simplicity, it is obvious that padding material would be used to cover the panels of the sofa-bed of the invention. A foldable one-piece mattress or separate cushions could be utilized in equivalent fashion to cover the panels of the deck in both the bed and sofa configurations.

While the embodiments shown in the figures feature the specific characteristics and shapes therein described, the invention can obviously take other shapes with equivalent functionality and utility. In fact, any shape for any of the components that retains the functional characteristics described above provides an acceptable apparatus to practice the invention. Similarly, a variety of other components that are not essential to the functioning of the invention, such as padding strips or additional support braces for the deck or for the inverted-L mechanism, could be introduced by one skilled in the art to fit the needs of specific applications.

Various changes in the details, steps and materials that have been described may be made by those skilled in the art within the principles and scope of the invention herein illustrated and defined in the appended claims. Therefore, while the present invention has been shown and described herein in what is believed to be the most practical and preferred embodiment, it is recognized that departures can be made therefrom within the scope of the invention, which is therefore not to be limited to the details disclosed herein but is to be accorded the full scope of the claims so as to embrace any and all equivalent apparatus and methods.

I claim:

1. A convertible sofa-bed adaptable for alternative use in a sofa or a bed configuration, comprising:

(a) a support frame having a horizontal supporting surface;

(b) a three-panel deck including a rear panel hingedly connected to said support frame, a middle panel hingedly connected to the rear panel along a first deck break-line, and a front panel hingedly connected to the middle panel along a second deck break-line, wherein said deck rests on said supporting surface and is capable of being folded along the deck break-lines between panels;

(c) a substantially L-shaped mechanism connected to said support frame by a pivotal attachment, said mechanism having a vertical arm disposed downward and a horizontal arm disposed under said rear panel, such that the rotation of the mechanism about said pivotal attachment to the support frame causes said horizontal arm to push said rear panel upward, thereby initiating the folding of the deck along said first deck break-line; and (d) means for effecting the rotation of said substantially L-shaped mechanism about said pivotal attachment to the support frame.

2. The convertible sofa-bed of claim 1, wherein said support frame also comprises a bracket having a hinge opening for providing said pivotal attachment of the substantially L-shaped mechanism, and wherein said substantially L-shaped mechanism consists of two equal L-shaped structures disposed in overlapping relationship, each structure having a vertical arm and a horizontal arm forming a right-angle elbow therebetween, each of said vertical arms being rigidly connected to one another, said horizontal arms having a tip disposed approximately below said first deck break-line, and said elbows being connected by a hinge pin passing through the hinge opening in said bracket.

3. The convertible sofa-bed of claim 2, wherein vertical arms are rigidly connected by a pin, and said means for effecting the rotation of said substantially L-shaped mechanism consists of a cord attached to said pin and to said front panel in tightly drawn relationship when the sofa-bed is open for use in a bed configuration, so that the folding of the front panel along said second deck break-line causes the rotation of the mechanism about said hinge pin and the upward lifting of said tips disposed approximately below said first deck break-line.

4. The convertible sofa-bed of claim 1, wherein said support frame also comprises a bracket having a hinge opening for providing said pivotal attachment of the substantially L-shaped mechanism, and wherein said substantially L-shaped mechanism consists of two equal L-shaped structures disposed in overlapping relationship, each structure having a vertical arm and a horizontal arm forming a right-angle elbow therebetween, each of said vertical arms being rigidly connected to one another, said elbows being disposed approximately below said first deck break-line, and said horizontal arms having a tip connected by a hinge pin passing through the hinge opening in said bracket.

5. The convertible sofa-bed of claim 4, wherein vertical arms are rigidly connected by a pin, and said means for effecting the rotation of said substantially L-shaped mechanism consists of a cord attached to said pin and to said front panel in tightly drawn relationship when the sofa-bed is open for use in a bed configuration, so that the folding of the front panel along said second deck break-line causes the rotation of the mechanism about said hinge pin and the upward lifting of said elbows disposed approximately below said first deck break-line.

6. The convertible sofa-bed of claim 1, wherein said means for effecting the rotation of said substantially L-shaped mechanism about said pivotal attachment to the support frame consists of a cord attached to said vertical arm of the substantially L-shaped mechanism and to said front panel in tightly drawn relationship when the sofa-bed is open for use in a bed configuration, so that the folding of the front panel along said first deck break-line causes the rotation of the mechanism and the upward lifting of said rear panel.

* * * * *